US008771385B2

(12) United States Patent
Griffins et al.

(10) Patent No.: US 8,771,385 B2
(45) Date of Patent: Jul. 8, 2014

(54) FUEL COMPOSITIONS

(75) Inventors: Claire Griffins, Ince Chester (GB); Richard Hugh Clark, Ince Chester (GB); Christopher William Clayton, Ince Chester (GB); Paul Anthony Stevenson, Ince Chester (GB); Robert Wilfred Matthews Wardle, Ince Chester (GB)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 13/142,315

(22) PCT Filed: Dec. 28, 2009

(86) PCT No.: PCT/EP2009/067950

§ 371 (c)(1), (2), (4) Date: Aug. 22, 2011

(87) PCT Pub. No.: WO2010/076303

PCT Pub. Date: Jul. 8, 2010

(65) Prior Publication Data

US 2012/0090224 A1 Apr. 19, 2012

(30) Foreign Application Priority Data

Dec. 29, 2008 (EP) ..... 08173002

(51) Int. Cl.
*C10L 1/222* (2006.01)
*C10L 1/223* (2006.01)
*C10L 1/10* (2006.01)

(52) U.S. Cl.
USPC ..... 44/426; 44/424; 44/425

(58) Field of Classification Search
CPC ..... C10L 1/223
USPC ..... 44/424–426, 436, 350, 412–414
See application file for complete search history.

(56) References Cited

U.S. PATENT DOCUMENTS

| | | | | |
|---|---|---|---|---|
| 2,878,109 | A * | 3/1959 | Wood et al. | 44/444 |
| 2,930,680 | A | 3/1960 | Smith, Jr. | |
| 2,982,627 | A * | 5/1961 | Lauer et al. | 44/355 |
| 4,125,566 | A | 11/1978 | Dinh et al. | |
| 4,208,190 | A | 6/1980 | Malec | |
| 4,389,220 | A | 6/1983 | Kracklauer | |
| 4,478,955 | A | 10/1984 | Pesa et al. | |
| 4,723,963 | A * | 2/1988 | Taylor | 44/436 |
| 4,908,045 | A | 3/1990 | Farrar | |
| 5,378,348 | A | 1/1995 | Davis et al. | |
| 5,490,864 | A | 2/1996 | Herbstman et al. | |
| 5,766,274 | A | 6/1998 | Wittenbrink et al. | |
| 5,888,376 | A | 3/1999 | Wittenbrink et al. | |
| 6,204,426 | B1 | 3/2001 | Miller et al. | |
| 6,833,484 | B2 * | 12/2004 | O'Rear | 585/1 |
| 7,300,476 | B1 * | 11/2007 | Huff et al. | 44/300 |
| 2002/0108298 | A1 * | 8/2002 | Yeh | 44/437 |
| 2004/0152930 | A1 * | 8/2004 | O'Rear et al. | 585/1 |
| 2005/0086854 | A1 * | 4/2005 | Millington et al. | 44/385 |
| 2006/0138022 | A1 | 6/2006 | Miller et al. | |
| 2009/0013589 | A1 * | 1/2009 | Aradi et al. | 44/359 |

FOREIGN PATENT DOCUMENTS

| | | | |
|---|---|---|---|
| EP | 078249 | A1 | 5/1983 |
| EP | 0147240 | A2 | 7/1985 |
| EP | 0147873 | A1 | 7/1985 |
| EP | 0252606 | A2 | 1/1988 |
| EP | 0482253 | A1 | 4/1992 |
| EP | 0583836 | B2 | 2/1994 |
| EP | 0613938 | A1 | 9/1994 |
| EP | 1101813 | A1 | 5/2001 |
| EP | 1411108 | A1 | 4/2004 |
| FR | 114011 | A1 | 11/1955 |
| GB | 835870 | | 5/1960 |
| GB | 960493 | | 6/1964 |
| GB | 1477806 | A | 6/1977 |
| GB | 2077289 | A | 12/1981 |
| JP | 54085205 | A * | 7/1979 |
| JP | 56057886 | A * | 5/1981 |
| JP | 59197492 | A | 4/1983 |
| WO | 936194 | A1 | 4/1993 |
| WO | 9417160 | A1 | 8/1994 |

(Continued)

OTHER PUBLICATIONS

Danping Wi, "The Lubricity of Diesel Fuels", Research Institute of Petroleum Processing, Beijing, China; Jan. 29, 1986; pp. 217-235.

Nishiumi, Ryoji, et al. (Toyota Motor Corp.), "Effects of Cetane Number and Distillation Characteristics of Paraffinic Diesel Fuels on PM Emiission from a DI Diesel Engine", 2004.

Steiger, Wolfgan, Dr. Ing, Literature; 2004; p. 165.

(Continued)

*Primary Examiner* — Pamela H Weiss

(57) ABSTRACT

Use in a gas oil fuel composition, which preferably comprises a Fischer-Tropsch derived fuel, of a compound according to formula (I): wherein: $R_1$ to $R_5$ are each independently hydrogen or a $C_{1-10}$ alkyl group, where such alkyl groups may be the same as or different from one another; X is a nitrogen- or oxygen-containing group, for the purpose of reducing the cetane number of said fuel composition; preparation of such a fuel composition; and operating a fuel consuming system.

(I)

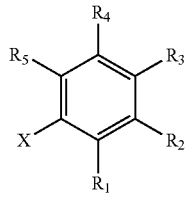

10 Claims, No Drawings

(56) References Cited

FOREIGN PATENT DOCUMENTS

| | | | |
|---|---|---|---|
| WO | 9422988 | A1 | 10/1994 |
| WO | 9523836 | A1 | 9/1995 |
| WO | 9533805 | A1 | 12/1995 |
| WO | 9714768 | A1 | 4/1997 |
| WO | 9714769 | A1 | 4/1997 |
| WO | 9801516 | A1 | 1/1998 |
| WO | 9842808 | A1 | 10/1998 |
| WO | 0011116 | A1 | 3/2000 |
| WO | 0011117 | A1 | 3/2000 |
| WO | 0020534 | A1 | 4/2000 |
| WO | 0020535 | A1 | 4/2000 |
| WO | 0183406 | A2 | 11/2001 |
| WO | 0183641 | A2 | 11/2001 |
| WO | 0183647 | A2 | 11/2001 |
| WO | 0183648 | A2 | 11/2001 |
| WO | 2007020234 | A1 | 2/2007 |
| WO | 2008088212 | A1 | 7/2008 |

OTHER PUBLICATIONS

Van der Burgt, Maarten et al., "The Shell Middle Distillate Synthesis Process"; Petroleum Review—Apr. 1990; p. 204.

* cited by examiner

FUEL COMPOSITIONS

PRIORITY CLAIM

The present application claims priority from PCT/EP2009/067950, filed 28 Dec. 2009, which claims priority from European Application 08173002.0, filed 29 Dec. 2008.

The present invention relates to gas oil fuels and gas oil fuel compositions and to their preparation and use, particularly to the use of certain types of fuel additives and components in such fuel compositions, more particularly to controlling the cetane number of diesel fuel and fuel compositions.

The cetane number of a fuel or fuel composition is a measure of its ease of ignition and combustion. With a lower cetane number fuel a compression ignition (diesel) engine tends to be more difficult to start and may run more noisily when cold; conversely a fuel of higher cetane number tends to impart easier cold starting, to alleviate white smoke ("cold smoke") caused by incomplete combustion after starting and to have a positive impact on emissions such as NOx and particulate matter during engine operation.

There is a general preference, therefore, for a diesel fuel or fuel composition to have a high cetane number, a preference which has become stronger as emissions legislation grows increasingly stringent, and as such automotive diesel specifications generally stipulate a minimum cetane number.

However, it has been found that a high cetane number has been linked with increased emissions of particulates and black smoke from some diesel engines.

Moreover, in "*Effects of Cetane Number and Distillation Characteristics of Paraffinic Diesel Fuels on PM Emission from a DI Diesel Engine*", Nishiumi et al., SAE 2004-01-2960, it is described that high cetane numbers leading to shorter ignition delays can result in poor mixing of injected fuel and air in the combustion chamber. This can lead to worse combustion and increased total hydrocarbon and carbon monoxide emissions.

Furthermore, in "*Potenziale Synthetischer Kraftstoffe im CCS Brennverfahren*", Steiger et al., a paper presented at the 25th Vienna Engine symposium, it is stated that direct injection systems like CCS (Combined Combustion System, also known as HCCI) benefit from fuels which offer most complete homogenisation after injection but before start of combustion, such as synthetic fuels which exhibit beneficial properties including rapid and complete evaporation due to low boiling point, freedom from sulphur and aromatics, low cetane number and long ignition delay.

Therefore, there are circumstances when it may be desirable to reduce the cetane number of a fuel or fuel composition.

It is well known that Fischer-Tropsch derived fuels exhibit cetane numbers that are higher than those of conventional, petroleum derived base fuels. It is, therefore, also well known that the cetane numbers of such mineral base fuels can be increased by blending in Fischer-Tropsch derived fuels.

The situation can, therefore, arise where, for example, a fuel or fuel blend containing a Fischer-Tropsch derived fuel exhibits a higher cetane number than is desirable. This could, of course, for example be corrected by blending in petroleum derived base fuel so as to reduce the proportion of the Fischer-Tropsch derived fuel in the blend. However, such a course of action could then have the effect of adversely affecting other properties of the fuel or fuel blend, for example the sulphur content, aromatics content or density.

It has been found that the cetane number of a gas oil composition, for example which comprises a Fischer-Tropsch derived fuel, can be reduced by including in the fuel composition a certain type of compound. Such a compound is according to formula (I):

(I)

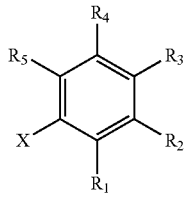

wherein:

$R_1$ to $R_5$ are each independently hydrogen or a $C_{1-10}$ alkyl group, where such alkyl groups may be the same as or different from one another; and X is a nitrogen- or oxygen-containing group.

In accordance with the present invention there is provided a gas oil fuel composition comprising a compound according to formula (I):

(I)

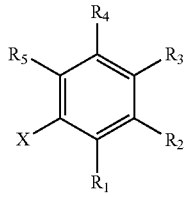

wherein:

$R_1$ to $R_5$ are each independently hydrogen or a $C_{1-10}$ alkyl group, where such alkyl groups may be the same as or different from one another; and X is a nitrogen- or oxygen-containing group.

In this and other aspects of the present invention, preferably each of said alkyl groups is a $C_{1-8}$, more preferably $C_{1-5}$, yet more preferably $C_{1-3}$, alkyl group.

In this and other aspects of the present invention, preferably said nitrogen-containing group is selected from amine functional groups. More preferably, said nitrogen-containing group is a substituted or unsubstituted amino group, yet more preferably an aminoalkyl group, most preferably an aminomethyl group.

In this and other aspects of the present invention, preferably said oxygen-containing group is selected from hydroxyl functional groups.

In the various aspects of the present invention, preferably the fuel composition comprises at least one base fuel. More preferably, said at least one base fuel comprises a diesel base fuel.

In the various aspects of the present invention, preferably the fuel composition comprises at least one Fischer-Tropsch derived fuel.

In the various aspects of the present invention, preferably said compound according to formula (1) is N-methyl aniline (NMA) (available ex. Sigma-Aldrich).

"Base fuel" is defined as being a material that is in accordance with one or more published base fuel standard specifications.

Preferably, said one or more published base fuel standard specifications are selected from EN 590, Swedish Class 1 (as defined by the Swedish Standard for EC1), ASTM D975 and Defence Standard 91-91 (Def Stan 91-91) specifications. EN 590:2004 is the current European Standard for diesel fuels. SS 155435:2006 is the current Swedish Standard for EC1. ASTM D975-07a is the current United States Standard Specification for Diesel Fuel Oils. Def Stan 91-91 Issue 5 Amendment 2 is the current UK standard for Turbine Fuel, Aviation Kerosine Type, Jet A-1.

In accordance with the present invention there is also provided the use in a gas oil fuel composition of a compound according to formula (I):

(I)

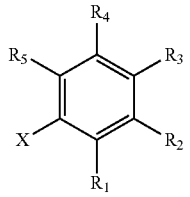

wherein:

$R_1$ to $R_5$ are each independently hydrogen or a $C_{1-10}$ alkyl group, where such alkyl groups may be the same as or different from one another; and X is a nitrogen- or oxygen-containing group, for the purpose of reducing the cetane number of said fuel composition.

Preferably, the (active matter) concentration of the compound according to formula (1) in a fuel composition according to the present invention will be up to 50000 mg/kg, more preferably up to 30000 mg/kg, still more preferably up to 25000 mg/kg, yet more preferably up to 20000 mg/kg, yet more preferably up to 10000 mg/kg, most preferably up to 3000 mg/kg. Its (active matter) concentration will preferably be at least 10 mg/kg, more preferably at least 100 mg/kg, most preferably at least 1000 mg/kg.

Preferably, the concentration of the Fischer-Tropsch derived fuel in a fuel composition according to the present invention will be up to 100% vol, more preferably up to 25% vol, most preferably up to 20% vol. Its concentration will preferably be at least 1% vol, more preferably at least 5% vol, most preferably at least 10% vol.

Middle distillate fuel compositions for which the present invention is used may include for example industrial gas oils, automotive diesel fuels, distillate marine fuels or kerosene fuels such as aviation fuels or heating kerosene. Typically, the composition will be an automotive diesel fuel. Preferably, the fuel composition to which the present invention is applied is for use in an internal combustion engine; more preferably, it is an automotive fuel composition, yet more preferably a diesel fuel composition which is suitable for use in an automotive diesel (compression ignition) engine.

In the context of the present invention, a middle distillate base fuel will typically contain a major proportion of, or consist essentially or entirely of, a middle distillate hydrocarbon base fuel. A "major proportion" means typically 80% vol or greater, more suitably 90 or 95% vol or greater, most preferably 98 or 99 or 99.5% vol or greater.

The fuel compositions to which the present invention relates include diesel fuels for use in automotive compression ignition engines.

The base fuel may itself comprise a mixture of two or more different diesel fuel components, and/or be additivated as described below.

Such diesel base fuels will contain one or more base fuels which may typically comprise liquid hydrocarbon middle distillate gas oil(s), for instance petroleum derived gas oils. Such fuels will typically have boiling points within the usual diesel range of 150 to 400° C., depending on grade and use. They will typically have a density from 750 to 1000 kg/m$^3$, preferably from 780 to 860 kg/m$^3$, at 15° C. (e.g. ASTM D4502 or IP 365) and a cetane number (ASTM D613) of from 35 to 120, more preferably from 40 to 85. They will typically have an initial boiling point in the range 150 to 230° C. and a final boiling point in the range 290 to 400° C. Their kinematic viscosity at 40° C. (ASTM D445) might suitably be from 1.2 to 4.5 mm$^2$/s.

An example of a petroleum derived gas oil is a Swedish Class 1 base fuel, which will have a density from 800 to 820 kg/m$^3$ at 15° C. (SS-EN ISO 3675, SS-EN ISO 12185), a T95 of 320° C. or less (SS-EN ISO 3405) and a kinematic viscosity at 40° C. (SS-EN ISO 3104) from 1.4 to 4.0 mm$^2$/s, as defined by the Swedish national specification EC1.

Such industrial gas oils will contain a base fuel which may comprise fuel fractions such as the kerosene or gas oil fractions obtained in traditional refinery processes, which upgrade crude petroleum feedstock to useful products. Preferably, such fractions contain components having carbon numbers in the range 5 to 40, more preferably 5 to 31, yet more preferably 6 to 25, most preferably 9 to 25, and such fractions have a density at 15° C. of 650 to 1000 kg/m$^3$, a kinematic viscosity at 20° C. of 1 to 80 mm$^2$/s, and a boiling range of 150 to 400° C.

Kerosene fuels will typically have boiling points within the usual kerosene range of 130 to 300° C., depending on grade and use. They will typically have a density from 775 to 840 kg/m$^3$, preferably from 780 to 830 kg/m$^3$, at 15° C. (e.g. ASTM D4502 or IP 365). They will typically have an initial boiling point in the range 130 to 160° C. and a final boiling point in the range 220 to 300° C. Their kinematic viscosity at −20° C. (ASTM 0445) might suitably be from 1.2 to 8.0 mm$^2$/s.

The Fischer-Tropsch derived fuels may for example be derived from natural gas, natural gas liquids, petroleum or shale oil, petroleum or shale oil processing residues, coal or biomass.

Such a Fischer-Tropsch derived fuel is any fraction of the middle distillate fuel range, which can be isolated from the (optionally hydrocracked) Fischer-Tropsch synthesis product. Typical fractions will boil in the naphtha, kerosene or gas oil range. Preferably, a Fischer-Tropsch product boiling in the kerosene or gas oil range is used because these products are easier to handle in for example domestic environments. Such products will suitably comprise a fraction larger than 90 wt % which boils between 160 and 400° C., preferably to about 370° C. Examples of Fischer-Tropsch derived kerosene and gas oils are described in EP-A-0583836, WO-A-97/14768, WO-A-97/14769, WO-A-00/11116, WO-A-00/11117, WO-A-01/83406, WO-A-01/83648, WO-A-01/83647, WO-A-01/83641, WO-A-00/20535, WO-A-00/20534, EP-A-1101813, U.S. Pat. No. 5,766,274, U.S. Pat. No. 5,378,348, U.S. Pat. No. 5,888,376 and U.S. Pat. No. 6,204,426.

The Fischer-Tropsch product will suitably contain more than 80% wt and more suitably more than 95% wt iso and normal paraffins and less than 1 wt % aromatics, the balance being naphthenics compounds. The content of sulphur and nitrogen will be very low and normally below the detection limits for such compounds. For this reason the sulphur content of a fuel composition containing a Fischer-Tropsch product may be very low.

The fuel composition preferably contains no more than 5000 ppmw sulphur, more preferably no more than 500 ppmw, or no more than 350 ppmw, or no more than 150 ppmw, or no more than 100 ppmw, or no more than 70 ppmw, or no more than 50 ppmw, or no more than 30 ppmw, or no more than 20 ppmw, or most preferably no more than 15 ppmw sulphur.

A petroleum derived gas oil may be obtained from refining and optionally (hydro)processing a crude petroleum source. It may be a single gas oil stream obtained from such a refinery process or a blend of several gas oil fractions obtained in the refinery process via different processing routes. Examples of such gas oil fractions are straight run gas oil, vacuum gas oil, gas oil as obtained in a thermal cracking process, light and heavy cycle oils as obtained in a fluid catalytic cracking unit and gas oil as obtained from a hydrocracker unit. Optionally, a petroleum derived gas oil may comprise some petroleum derived kerosene fraction.

Such gas oils may be processed in a hydrodesulphurisation (HDS) unit so as to reduce their sulphur content to a level suitable for inclusion in a diesel fuel composition.

In the present invention, a base fuel may be or contain a so-called "biodiesel" fuel component, such as a vegetable oil or vegetable oil derivative (e.g. a fatty acid ester, in particular a fatty acid methyl ester) or another oxygenate such as an acid, ketone or ester. Such components need not necessarily be bio-derived. It may also contain fuels derived from hydrogenated vegetable oils.

Fischer-Tropsch derived fuels are known and in use in diesel fuel compositions. They are, or are prepared from, the synthesis products of a Fischer-Tropsch condensation reaction, as for example the commercially used gas oil obtained from the Shell Middle Distillate Synthesis (Gas-To-Liquid) process operating in Bintulu, Malaysia.

By "Fischer-Tropsch derived" is meant that a fuel is, or derives from, a synthesis product of a Fischer-Tropsch condensation process. A Fischer-Tropsch derived fuel may also be referred to as a GTL (Gas-to-Liquid) fuel.

The Fischer-Tropsch reaction converts carbon monoxide and hydrogen into longer chain, usually paraffinic, hydrocarbons:

$$n(CO+2H_2)=(-CH_2-)_n+nH_2O+\text{heat},$$

in the presence of an appropriate catalyst and typically at elevated temperatures (e.g. 125 to 300° C., preferably 175 to 250° C.) and/or pressures (e.g. 5 to 100 bar, preferably 12 to 50 bar). Hydrogen:carbon monoxide ratios other than 2:1 may be employed if desired.

The carbon monoxide and hydrogen may themselves be derived from organic or inorganic, natural or synthetic sources, typically either from natural gas or from organically derived methane. The gases which are converted into liquid fuel components using such processes can in general include natural gas (methane), LPG (e.g. propane or butane), "condensates" such as ethane, synthesis gas (CO/hydrogen) and gaseous products derived from coal, biomass and other hydrocarbons.

Gas oil, naphtha and kerosene products may be obtained directly from the Fischer-Tropsch reaction, or indirectly for instance by fractionation of Fischer-Tropsch synthesis products or from hydrotreated Fischer-Tropsch synthesis products. Hydrotreatment can involve hydrocracking to adjust the boiling range (see, e.g., GB-B-2077289 and EP-A-0147873) and/or hydroisomerisation which can improve cold flow properties by increasing the proportion of branched paraffins. EP-A-0583836 describes a two step hydrotreatment process in which a Fischer-Tropsch synthesis product is firstly subjected to hydroconversion under conditions such that it undergoes substantially no isomerisation or hydrocracking (this hydrogenates the olefinic and oxygen-containing components), and then at least part of the resultant product is hydroconverted under conditions such that hydrocracking and isomerisation occur to yield a substantially paraffinic hydrocarbon fuel. The desired gas oil fraction(s) may subsequently be isolated for instance by distillation.

Other post-synthesis treatments, such as polymerisation, alkylation, distillation, cracking-decarboxylation, isomerisation and hydroreforming, may be employed to modify the properties of Fischer-Tropsch condensation products, as described for instance in U.S. Pat. No. 4,125,566 and U.S. Pat. No. 4,478,955.

Typical catalysts for the Fischer-Tropsch synthesis of paraffinic hydrocarbons comprise, as the catalytically active component, a metal from Group VIII of the periodic table, in particular ruthenium, iron, cobalt or nickel. Suitable such catalysts are described for instance in EP-A-0583836 (pages 3 and 4).

As indicated above, an example of a Fischer-Tropsch based process is the SMDS (Shell Middle Distillate Synthesis) described by van der Burgt et al in "The Shell Middle Distillate Synthesis Process", paper delivered at the 5th Synfuels Worldwide Symposium, Washington D.C., November 1985 (see also the November 1989 publication of the same title from Shell International Petroleum Company Ltd, London, UK). This process (also sometimes referred to as the Shell "Gas-To-Liquids" or "GTL" technology) produces middle distillate range products by conversion of a natural gas (primarily methane) derived synthesis gas into a heavy long chain hydrocarbon (paraffin) wax which can then be hydroconverted and fractionated to produce liquid transport fuels such as the gas oils useable in diesel fuel compositions. A version of the SMDS process, utilising a fixed bed reactor for the catalytic conversion step, is that currently in use in Bintulu, Malaysia, and its gas oil products have been blended with petroleum derived gas oils in commercially available automotive fuels.

Gas oils, naphthas and kerosenes prepared by the SMDS process are commercially available, for instance from Shell companies.

By virtue of the Fischer-Tropsch process, a Fischer-Tropsch derived fuel has essentially no, or undetectable levels of, sulphur and nitrogen. Compounds containing these heteroatoms tend to act as poisons for Fischer-Tropsch catalysts and are therefore removed from the synthesis gas feed.

Generally speaking, Fischer-Tropsch derived fuels have relatively low levels of polar components, in particular polar surfactants, for instance compared to petroleum derived fuels. Such polar components may include for example oxygenates, and sulphur- and nitrogen-containing compounds. A low level of sulphur in a Fischer-Tropsch derived fuel is generally indicative of low levels of both oxygenates and nitrogen containing compounds, since all are removed by the same treatment processes.

Where a Fischer-Tropsch derived fuel component is a naphtha fuel, it will be a liquid hydrocarbon distillate fuel with a final boiling point of typically up to 220° C. or preferably of 180° C. or less. Its initial boiling point is preferably higher than 25° C., more preferably higher than 35° C. Its components (or the majority, for instance 95% w/w or greater, thereof) are typically hydrocarbons having 5 or more carbon atoms; they are usually paraffinic.

In the context of the present invention, a Fischer-Tropsch derived naphtha fuel preferably has a density of from 0.67 to 0.73 g/cm$^3$ at 15° C. and/or a sulphur content of 5 mg/kg or less, preferably 2 mg/kg or less. It preferably contains 95% w/w or greater of iso- and normal paraffins, preferably from 20 to 98% w/w or greater of normal paraffins. It is preferably the product of a SMDS process, preferred features of which may be as described below in connection with Fischer-Tropsch derived gas oils.

A Fischer-Tropsch derived kerosene fuel is a liquid hydrocarbon middle distillate fuel with a distillation range suitably from 140 to 260° C., preferably from 145 to 255° C., more preferably from 150 to 250° C. or from 150 to 210° C. It will have a final boiling point of typically from 190 to 260° C., for instance from 190 to 210° C. for a typical "narrow-cut" kerosene fraction or from 240 to 260° C. for a typical "full-cut" fraction. Its initial boiling point is preferably from 140 to 160° C., more preferably from 145 to 160° C.

A Fischer-Tropsch derived kerosene fuel preferably has a density of from 0.730 to 0.760 g/cm$^3$ at 15° C.—for instance from 0.730 to 0.745 g/cm$^3$ for a narrow-cut fraction and from 0.735 to 0.760 g/cm$^3$ for a full-cut fraction. It preferably has a sulphur content of 5 mg/kg or less. It may have a cetane number of from 63 to 75, for example from 65 to 69 for a narrow-cut fraction or from 68 to 73 for a full-cut fraction. It is preferably the product of a SMDS process, preferred features of which may be as described below in connection with Fischer-Tropsch derived gas oils.

A Fischer-Tropsch derived gas oil should be suitable for use as a diesel fuel, ideally as an automotive diesel fuel; its components (or the majority, for instance 95% v/v or greater, thereof) should therefore have boiling points within the typical diesel fuel ("gas oil") range, i.e. from 150 to 400° C. or from 170 to 370° C. It will suitably have a 90% v/v distillation temperature of from 300 to 370° C.

A Fischer-Tropsch derived gas oil will typically have a density from 0.76 to 0.79 g/cm$^3$ at 15° C.; a cetane number (ASTM D613) greater than 70, suitably from 74 to 85; a kinematic viscosity (ASTM D445) from 2 to 4.5, preferably from 2.5 to 4.0, more preferably from 2.9 to 3.7, mm$^2$/s at 40° C.; and a sulphur content (ASTM D2622) of 5 mg/kg or less, preferably of 2 mg/kg or less.

Preferably, a Fischer-Tropsch derived fuel component used in the present invention is a product prepared by a Fischer-Tropsch methane condensation reaction using a hydrogen/carbon monoxide ratio of less than 2.5, preferably less than 1.75, more preferably from 0.4 to 1.5, and ideally using a cobalt containing catalyst. Suitably, it will have been obtained from a hydrocracked Fischer-Tropsch synthesis product (for instance as described in GB-B-2077289 and/or EP-A-0147873), or more preferably a product from a two-stage hydroconversion process such as that described in EP-A-0583836 (see above). In the latter case, preferred features of the hydroconversion process may be as disclosed at pages 4 to 6, and in the examples, of EP-A-0583836.

Suitably, a Fischer-Tropsch derived fuel component used in the present invention is a product prepared by a low temperature Fischer-Tropsch process, by which is meant a process operated at a temperature of 250° C. or lower, such as from 125 to 250° C. or from 175 to 250° C., as opposed to a high temperature Fischer-Tropsch process which might typically be operated at a temperature of from 300 to 350° C.

Suitably, in accordance with the present invention, a Fischer-Tropsch derived fuel will consist of at least 70% wt, preferably at least 80% wt, more preferably at least 90 or 95 or 98% wt, most preferably at least 99 or 99.5 or even 99.8% wt, of paraffinic components, preferably iso- and normal paraffins. The weight ratio of iso-paraffins to normal paraffins will suitably be greater than 0.3 and may be up to 40; suitably it is from 2 to 40. The actual value for this ratio will be determined, in part, by the hydroconversion process used to prepare the gas oil from the Fischer-Tropsch synthesis product.

The Fischer-Tropsch derived gas oil component which is used in the present invention preferably comprises at least 75% wt, more preferably at least 80% wt, most preferably at least 85% wt, of iso-paraffins.

The olefin content of the Fischer-Tropsch derived fuel component is suitably 0.5% wt or lower. Its aromatics content is suitably 0.5% wt or lower.

Said Fischer-Tropsch derived gas oil component may be as described above. Also suitable as said Fischer-Tropsch derived gas oil component is a Fischer-Tropsch product that has been processed to produce a catalytically dewaxed gas oil or gas oil blending component. A suitable process for this purpose involves the steps of (a) hydrocracking/hydroisomerising a Fischer-Tropsch product; (b) separating the product of step (a) into at least one or more fuel fractions and a gas oil precursor fraction; (c) catalytically dewaxing the gas oil precursor fraction obtained in step (b), and (d) isolating the catalytically dewaxed gas oil or gas oil blending component from the product of step (c) by means of distillation.

A fuel composition according to the present invention may include a mixture of two or more fuel components, which preferably comprise at least one Fischer-Tropsch derived fuel.

In general, other products of gas-to-liquid processes may be suitable for inclusion in a fuel composition prepared according to the present invention. The gases which are converted into liquid fuel components using such processes can include natural gas (methane), LPG (e.g. propane or butane), "condensates" such as ethane, synthesis gas (CO/hydrogen) and gaseous products derived from coal, biomass and other hydrocarbons.

The base fuel may itself be additivated (additive-containing) or unadditivated (additive-free). If additivated, e.g. at the refinery, it will contain minor amounts of one or more additives selected for example from anti-static agents, pipeline drag reducers, flow improvers (e.g. ethylene/vinyl acetate copolymers or acrylate/maleic anhydride copolymers), lubricity additives, antioxidants and wax anti-settling agents.

Detergent-containing diesel fuel additives are known and commercially available. Such additives may be added to diesel fuels at levels intended to reduce, remove, or slow the build up of engine deposits.

Examples of detergents suitable for use in fuel additives for the present purpose include polyolefin substituted succinimides or succinamides of polyamines, for instance polyisobutylene succinimides or polyisobutylene amine succinamides, aliphatic amines, Mannich bases or amines and polyolefin (e.g. polyisobutylene) maleic anhydrides. Succinimide dispersant additives are described for example in GB-A-960493, EP-A-0147240, EP-A-0482253, EP-A-0613938, EP-A-0557516 and WO-A-98/42808. Particularly preferred are polyolefin substituted succinimides such as polyisobutylene succinimides.

The fuel additive mixture may contain other components in addition to the detergent. Examples are lubricity enhancers; dehazers, e.g. alkoxylated phenol formaldehyde polymers; anti-foaming agents (e.g. polyether-modified polysiloxanes); ignition improvers (cetane improvers) (e.g. 2-ethylhexyl nitrate (EHN), cyclohexyl nitrate, di-tert-butyl peroxide and those disclosed in U.S. Pat. No. 4,208,190 at column 2, line 27 to column 3, line 21); anti-rust agents (e.g. a propane-1,2-diol semi-ester of tetrapropenyl succinic acid, or polyhydric alcohol esters of a succinic acid derivative, the succinic acid derivative having on at least one of its alpha-carbon atoms an unsubstituted or substituted aliphatic hydrocarbon group containing from 20 to 500 carbon atoms, e.g. the pentaerythritol diester of polyisobutylene-substituted succinic acid); corrosion inhibitors; reodorants; anti-wear additives; anti-oxidants (e.g. phenolics such as 2,6-di-tert-butylphenol, or phenylenediamines such as N,N'-di-sec-butyl-p-phenylenediamine); metal deactivators; combustion improvers; static dissipator additives; cold flow improvers; and wax anti-settling agents.

The fuel additive mixture may contain a lubricity enhancer, especially when the fuel composition has a low (e.g. 500 ppmw or less) sulphur content. In the additivated fuel composition, the lubricity enhancer is conveniently present at a concentration of less than 1000 ppmw, preferably between 50 and 1000 ppmw, more preferably between 70 and 1000 ppmw. Suitable commercially available lubricity enhancers include ester- and acid-based additives. Other lubricity enhancers are described in the patent literature, in particular in connection with their use in low sulphur content diesel fuels, for example in:

- the paper by Danping Wei and H. A. Spikes, "*The Lubricity of Diesel Fuels*", Wear, III (1986) 217-235;
- WO-A-95/33805—cold flow improvers to enhance lubricity of low sulphur fuels;
- WO-A-94/17160—certain esters of a carboxylic acid and an alcohol wherein the acid has from 2 to 50 carbon atoms and the alcohol has 1 or more carbon atoms, particularly glycerol monooleate and di-isodecyl adipate, as fuel additives for wear reduction in a diesel engine injection system;
- U.S. Pat. No. 5,490,864—certain dithiophosphoric diester-dialcohols as anti-wear lubricity additives for low sulphur diesel fuels; and
- WO-A-98/01516—certain alkyl aromatic compounds having at least one carboxyl group attached to their aromatic nuclei, to confer anti-wear lubricity effects particularly in low sulphur diesel fuels.

It may also be preferred for the fuel composition to contain an anti-foaming agent, more preferably in combination with an anti-rust agent and/or a corrosion inhibitor and/or a lubricity enhancing additive.

Unless otherwise stated, the (active matter) concentration of each such additive component in the additivated fuel composition is preferably up to 10000 ppmw, more preferably in the range from 0.1 to 1000 ppmw, advantageously from 0.1 to 300 ppmw, such as from 0.1 to 150 ppmw.

The (active matter) concentration of any dehazer in the fuel composition will preferably be in the range from 0.1 to 20 ppmw, more preferably from 1 to 15 ppmw, still more preferably from 1 to 10 ppmw, advantageously from 1 to 5 ppmw. The (active matter) concentration of any ignition improver present will preferably be 2600 ppmw or less, more preferably 2000 ppmw or less, conveniently from 300 to 1500 ppmw. The (active matter) concentration of any detergent in the fuel composition will preferably be in the range from 5 to 1500 ppmw, more preferably from 10 to 750 ppmw, most preferably from 20 to 500 ppmw.

In the case of a diesel fuel composition, for example, the fuel additive mixture will typically contain a detergent, optionally together with other components as described above, and a diesel fuel-compatible diluent, which may be a mineral oil, a solvent such as those sold by Shell companies under the trade mark "SHELLSOL", a polar solvent such as an ester and, in particular, an alcohol, e.g. hexanol, 2-ethylhexanol, decanol, isotridecanol and alcohol mixtures such as those sold by Shell companies under the trade mark "LINEVOL", especially "LINEVOL 79" alcohol which is a mixture of $C_{7-9}$ primary alcohols, or a $C_{12-14}$ alcohol mixture which is commercially available.

The total content of the additives in the fuel composition may be suitably between 0 and 10000 ppmw and preferably below 5000 ppmw.

In this specification, amounts (concentrations, % vol, ppmw, % wt) of components are of active matter, i.e. exclusive of volatile solvents/diluent materials.

The present invention is particularly applicable where the fuel composition is used or intended to be used in a direct injection diesel engine, for example of the rotary pump, in-line pump, unit pump, electronic unit injector or common rail type, or in an indirect injection diesel engine. The fuel composition may be suitable for use in heavy and/or light duty diesel engines.

A diesel base fuel may be an automotive gas oil (AGO). A diesel base fuel used in the present invention will preferably have a sulphur content of at most 2000 ppmw (parts per million by weight). More preferably, it will have a low or ultra low sulphur content, for instance at most 500 ppmw, preferably no more than 350 ppmw, most preferably no more than 100 or 50 or 10 ppmw, of sulphur.

In the context of the present invention, "use" of an additive in a fuel composition means incorporating the additive into the composition, typically as a blend (i.e. a physical mixture) with one or more other fuel components. An additive will conveniently be incorporated before the composition is introduced into an internal combustion engine or other system which is to be run on the composition. Instead or in addition the use of an additive may involve running a fuel-consuming system, typically a diesel engine, on a fuel composition containing the additive, typically by introducing the composition into a combustion chamber of an engine.

Additives may be added at various stages during the production of a fuel composition; those added at the refinery for example might be selected from anti-static agents, pipeline drag reducers, flow improvers, lubricity enhancers, anti-oxidants and wax anti-settling agents. When carrying out the present invention, a base fuel may already contain such refinery additives. Other additives may be added downstream of the refinery.

In accordance with the present invention there is further provided a method of reducing the cetane number of a gas oil fuel composition, said method comprising adding a compound according to formula (I):

(I)

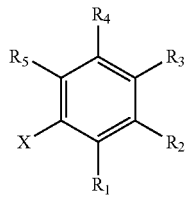

wherein:

$R_1$ to $R_5$ are each independently hydrogen or a $C_{1-10}$ alkyl group, where such alkyl groups may be the same as or different from one another; and X is a nitrogen- or oxygen-containing group, to said fuel composition.

In accordance with the present invention, there is further provided a process for the preparation of a gas oil fuel composition, which process comprises blending a compound according to formula (I):

(I)

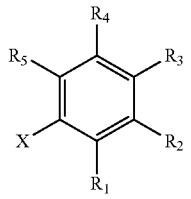

wherein:

$R_1$ to $R_5$ are each independently hydrogen or a $C_{1-10}$ alkyl group, where such alkyl groups may be the same as or different from one another; and X is a nitrogen- or oxygen-containing group, and at least one fuel component, said compound according to formula (1) preferably being included for the purpose of reducing the cetane number of said fuel composition.

In accordance with the present invention there is further provided a method of operating a fuel consuming system, which method comprises reducing the cetane number of a gas oil fuel composition by adding a compound according to formula (I):

(I)

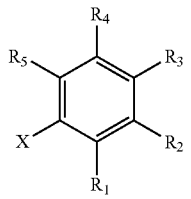

wherein:

$R_1$ to $R_5$ are each independently hydrogen or a $C_{1-10}$ alkyl group, where such alkyl groups may be the same as or different from one another;

X is a nitrogen- or oxygen-containing group, to said fuel composition, and then introducing into the system said fuel composition.

The system may in particular be an internal combustion engine, and/or a vehicle which is driven by an internal combustion engine, in which case the method involves introducing the relevant fuel or fuel composition into a combustion chamber of the engine. The engine is preferably a compression ignition (diesel) engine. Such a diesel engine may be of the types described above.

The present invention will now be further described by reference to the following Examples, in which, unless otherwise indicated, parts and percentages are by volume, and temperatures are in degrees Celsius.

EXAMPLES

Example 1

Blends of a Fischer-Tropsch derived gas oil A were prepared containing different concentrations of active N-methyl aniline (NMA) and were analysed using an Ignition Quality Tester (IQT) to determine the Derived Cetane Number (DCN) according to test method ASTM D6890/08 (Standard Test Method for Determination of ignition delay and derived cetane number (DCN) of diesel fuel oils by combustion in a constant volume chamber). The IQT analysis involves measurement of the Ignition Delay (ID) (the period of time, in milliseconds, between the start of fuel injection and the start of combustion) of the fuel by combustion in a constant volume chamber and conversion of ID to DCN by one of the following formulae:

$$DCN=4.460+186.6/ID$$

(valid for ID values in the range from 3.3 to 6.4 ms)

$$DCN=83.99(ID-1.512)^{(-0.658)}+3.547$$

(valid for ID values outside the range from 3.3 to 6.4 ms)

From the expression for DCN, it is clear that a shorter ignition delay time implies a higher DCN value, and vice versa.

The properties of Fischer-Tropsch derived gas oil A were as shown in Table 1:

TABLE 1

| Fuel property | | Test method |
|---|---|---|
| Density @ 15° C. (g/ml) | 0.7848 | IP 365/ASTM D4052 |
| Distillation (° C.) | | IP 123/ASTM D86 |
| IBP | 211 | |
| 10% | 251.3 | |
| 30% | 273.3 | |
| 50% | 297.3 | |
| 70% | 316.9 | |
| 90% | 339.1 | |
| 95% | 348.6 | |
| FBP | 355.3 | |
| Cetane number | >76 | ASTM D613 |
| Derived cetane number | 81.2 | ASTM D6890/08 |
| Sulphur (ppmw) | <3 | ASTM D2622 |
| Cloud Point (° C.) | 4 | ASTM D5773 |
| CFPP (° C.) | −1 | IP 309 |

The results of the analyses using NMA are shown in Table 2:

TABLE 2

| Sample No. | NMA (mg/kg) | Ignition delay (ms) | Derived cetane number |
|---|---|---|---|
| 1 | 0 | 2.638 | 81.2 |
| 2 | 100 | 2.619 | 82.1 |
| 3 | 1000 | 2.652 | 80.6 |
| 4 | 10000 | 2.758 | 76.2 |

It can be seen from Table 2 that it is possible to control, i.e. increase, the ignition delay and, therefore, decrease the derived cetane number, of a Fischer-Tropsch derived gas oil by the addition of a compound according to formula (I), namely NMA.

Example 1 investigates DCN values that are outside the "normal" cetane number used for automotive gas oil fuel. The following Example 2 will show the same effect of said NMA as described above when used in a mineral diesel fuel composition.

Example 2

Similar analyses to those in Example 1 were carried out in which blends of a mineral diesel fuel B were prepared containing different concentrations of active NMA.

The properties of the diesel fuel B were as shown in Table 3:

TABLE 3

| Fuel property | | Test method |
|---|---|---|
| Density @ 15° C. (g/ml) | 0.8295 | IP 365/ASTM D4052 |
| Distillation (° C.) | | IP 123/ASTM D86 |
| IBP | 175 | |
| 10% | 213.1 | |
| 30% | 247.9 | |
| 50% | 275 | |
| 70% | 300.8 | |
| 90% | 338 | |
| 95% | 354.7 | |
| FBP | 362.6 | |
| Cetane number | 56.5 | ASTM D613 |
| Derived cetane number | 55.5 | ASTM D6890/08 |
| Sulphur (ppmw) | 8 | ASTM D2622 |
| Cloud Point (° C.) | −3 | ASTM D5773 |
| CFPP (° C.) | −7 | IP 309 |

The results of the analyses using NMA are shown in Table 4:

TABLE 4

| Sample No. | NMA (% wt) | Ignition delay (ms) | Derived cetane number |
|---|---|---|---|
| 5 | 0 | 3.654 | 55.5 |
| 6 | 2.0 | 4.060 | 50.4 |

It can be seen from Table 4 that it is possible to control, i.e. increase, the ignition delay and, therefore, decrease the derived cetane number, of a mineral diesel fuel by the addition of a compound according to formula (I), namely NMA.

We claim:

1. A gas oil fuel composition comprising at least one base fuel, at least one Fischer-Tropsch derived fuel and a compound according to formula (I):

(I)

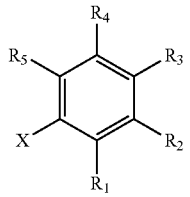

wherein each of $R_1$-$R_5$ is a $C_{1-3}$ alkyl group; and

X is a nitrogen-containing group.

2. A method of reducing the cetane number of a gas oil fuel composition, said fuel composition comprising at least one Fischer-Tropsch derived fuel, said method comprising adding a compound according to formula (I):

(I)

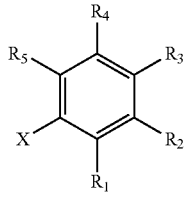

wherein each of $R_1$-$R_5$ is a $C_{1-3}$ alkyl group; and

X is a nitrogen-containing group, to said fuel composition.

3. A process for the preparation of a gas oil fuel composition, said fuel composition comprising at least one base fuel at least one Fischer-Tropsch derived fuel, which process comprises blending a compound according to formula (I):

(I)

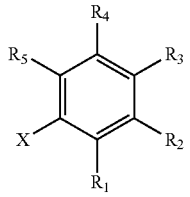

wherein each of $R_1$-$R_5$ is a $C_{1-3}$ alkyl group; and

X is a nitrogen-containing group, and at least one fuel component.

4. A method of operating a fuel consuming system, which method comprises reducing the cetane number of a gas oil fuel composition by adding a compound according to formula (I):

(I)

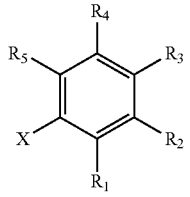

wherein each of $R_1$-$R_5$ is a $C_{1-3}$ alkyl group; and

X is a nitrogen-containing group, to said fuel composition, and then introducing into the system said fuel composition.

5. The composition of claim 1 wherein said at least one base fuel comprises a diesel base fuel.

6. The composition of claim 1, wherein said Fischer-Tropsch derived fuel is a gas oil, kerosene or naphtha.

7. The composition of claim 1, wherein the fuel composition includes at least 1 wt. % of the compound according to formula I.

8. The composition of claim 1, wherein the fuel composition includes up to 5 wt. % of the compound according to formula I.

9. The composition of claim 1, wherein the fuel composition comprises up to 25 wt. % of the Fischer-Tropsch derived fuel.

10. The composition of claim 1, wherein the fuel composition comprises at least 10 wt. % of the Fischer-Tropsch derived fuel.

* * * * *